US005414972A

United States Patent [19]

Ruiz et al.

[11] Patent Number: 5,414,972

[45] Date of Patent: May 16, 1995

[54] REINFORCED STRUCTURAL MEMBER FOR BUILDING CONSTRUCTIONS

[75] Inventors: Antonio R. Ruiz, San Pedro; Paul M. Clark, Jr., La Canada; George R. Tooth, Corona, all of Calif.

[73] Assignee: Composite Building Systems Incorporated, La Canada, Calif.

[21] Appl. No.: 149,662

[22] Filed: Nov. 9, 1993

[51] Int. Cl.[6] ..... E04B 5/04

[52] U.S. Cl. ..... 52/600; 52/335

[58] Field of Search ..... 52/600, 603, 596, 602, 52/327, 334, 340, 354, 356, 730.2, 731.7, 735

[56] References Cited

U.S. PATENT DOCUMENTS 4,930,278 6/1990 Staresina et al. ..... 52/600 X

FOREIGN PATENT DOCUMENTS 2159959 6/1973 Germany ..... 52/602

*Primary Examiner*—Carl D. Friedman
*Assistant Examiner*—Creighton Smith
*Attorney, Agent, or Firm*—Pretty, Schroeder, Brueggemann & Clark

[57] ABSTRACT

A reinforced structural member for connection to a building panel, such as a pre-fabricated building panel used to construct walls, floors and roofs of a building. The reinforced structural member is a two-piece assembly comprising a structural member and a reinforcing member. The reinforcing member is fastened to the structural member such that a plurality of projections extending from the reinforcing member engage the building panel. The reinforced structural member is especially adapted for use with composite or cementious materials, such as concrete. The reinforcing member substantially reinforces the structural member, while the projections on the reinforcing member securely embed within the concrete building panel. A U-shaped track, having projections which embed within the building panel, also may be used to brace the reinforced structural members relative to each other and to the building panel.

21 Claims, 3 Drawing Sheets

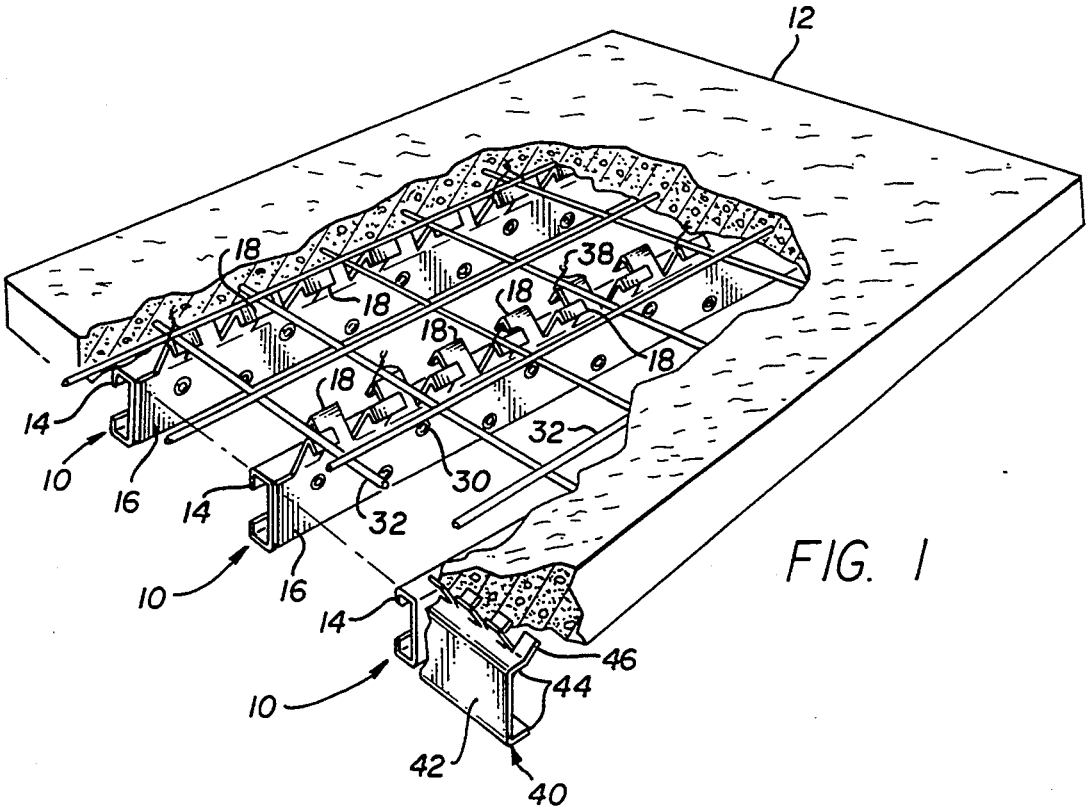
FIG. 1
FIG. 2
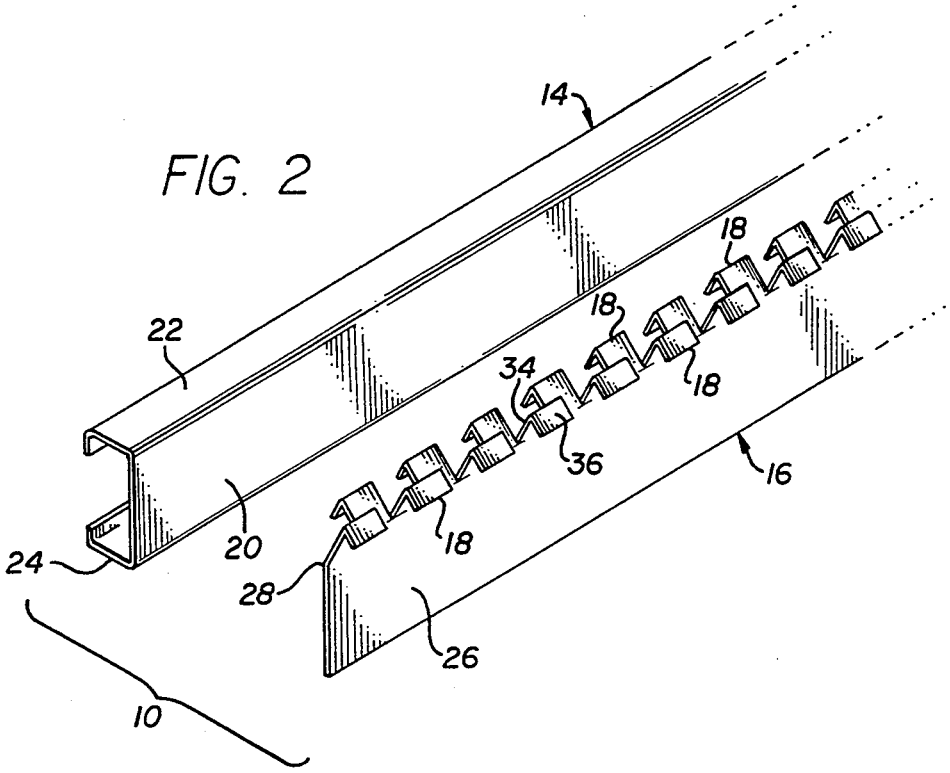

REINFORCED STRUCTURAL MEMBER FOR BUILDING CONSTRUCTIONS

BACKGROUND OF THE INVENTION

The present invention relates to building construction and, more particularly, to structural members for connection to building panels which are then used to construct walls, floors, roofs and the like.

Over the years, various methods have been developed to manufacture low-cost housing and other buildings that are relatively quick and simple to construct, without sacrificing the structural integrity of the finished structure. One such method employs pre-fabricated building panels, usually constructed from concrete, to form the walls, floors and roofs of the building structure. Such building panels can be constructed on or off-site and then moved into a specific position to form the walls, floors and roofs of the building structure. These pre-fabricated panels are reinforced and joined to each other by metal studs and joists embedded in the panels.

A typical prefabricated building panel has numerous parallel metal studs and joists embedded in a planar concrete panel. The concrete panel is usually 1.5 to 2 inches thick, although its thickness can vary depending on the particular application and the strength requirements needed. For increased strength, a reinforcing material, such as polypropylene-type fibers, steel fibers or mesh, often is embedded within the concrete panel. The metal studs, usually common C-shaped channel members, are placed parallel to each other, with their edges on or in the newly poured concrete panel. When the concrete hardens, the metal studs are permanently bonded to the panel, and the whole panel is thereafter transferred into a position to form part of the wall, floor or roof of a building.

It is generally recognized that the overall strength of a prefabricated building panel is, in large part, dependent upon the integrity of the bond that is created between the metal stud and the concrete panel, after the concrete has hardened. For example, a stud edge surface in simple contact with the surface of the concrete panel results in a relatively weak bond and, therefore, a relatively weak panel. Accordingly, it has become a common technique to provide projections on the edge of the stud that extend into the wet concrete, thereby securely anchoring the stud to the concrete panel when the concrete hardens.

By way of example, projections can be provided directly on the flange of a metal stud to anchor the stud to the panel. In one known method, the metal stud is shaped like a common "C" channel and has a planar central web and a pair of substantially perpendicular edge flanges. However, one edge flange has a series of spaced, longitudinally shaped cut-outs along its length, thereby permitting the cut-out portion of the edge flange to bend upwards and form a projection which can be embedded within the concrete material of the panel. A reinforcing mesh or the like can be mechanically attached to each projection so that the mesh is positioned at the proper depth within the panel.

Alternatively, a specially manufactured stud can be fabricated, in which one of the edge flanges has an increased length. This edge flange can be bent upwards in an appropriate fashion to provide a continuous projection for embedding within the concrete panel.

However, pre-fabricated building panels of the type described above are not without several known drawbacks. For example, the studs must be either specially modified (as in the case of the cut-outs on the edge flange to form projections) or specially manufactured (as in the case of edge flanges with increased length to form a continuous protrusion). This adds to the cost of labor and materials of the finished panel, since common, off-the-shelf C-shaped studs cannot be used. Moreover, since the stud must be specially modified or manufactured at an off-site manufacturing facility, the studs are not readily susceptible to further modifications or adjustments to meet unusual or special needs which may arise in the field.

In addition, as noted above, the projections on some studs are made out of material removed from the edge flange of the stud itself, thus weakening the stud in that area. Further, these projections are limited in size, shape and number because they are formed from the limited material provided by the width of the edge flange. A further problem associated with the studs described above is the relatively straight shape of the projections. Generally, projections having an angled or hooked shape will embed in the concrete more securely and provide a stronger bond. While the projections of known studs have a small portion which can be bent to form an angle, the relatively small size of the bent portion tends to limit its effectiveness.

Likewise, there is an existing and reoccurring problem of crazing or cracking longitudinally along the knife-like projection of the deformed studs currently being used to create site-cast building panels. Problems also have existed with the present methods that have been used to provide lateral bracing of the studs and joists of the building panels. The present methods of lateral bracing are relatively time consuming and undesirably add to the overall material and labor costs. There also is some doubt as to the effectiveness of these prior bracing methods.

Accordingly, there has existed a definite need for a structural member which provides a secure connection to a building panel, without requiring specially modified or manufactured studs or the like. There further has existed a need for a reinforcing member for use with a standard structural member, such as a stud or a joist, that both reinforces the structural member and securely connects it to the building panel. There also has existed a need for a better means for bracing the structural members connected to the building panel. The present invention satisfies these needs and provides further related advantages.

SUMMARY OF THE INVENTION

The present invention provides a reinforced structural member for connection to a building panel, such as a pre-fabricated building panel used to construct walls, floors and roofs of a building. The reinforced structural member is a two-piece assembly comprising a structural member and a reinforcing member. The reinforcing member is fastened to the structural member, thereby providing substantial additional reinforcement. The reinforcing member also has a plurality of projections extending from the reinforcing member for engagement with the building panel. This unique structural arrangement is relatively inexpensive to manufacture and simple to assemble, yet provides an extremely strong bond between the building panel and the reinforced structural member.

It will be appreciated that, while the reinforced structural member of the present invention is especially adapted for use with building panels made from composite or cementious materials, such as concrete, the building panel may be constructed from any other suitable building material. Accordingly, the material of the building panel may comprise any suitable material capable of hardening from a liquid or semi-liquid state to a solid state which will adhere to the projections of the reinforcing member which the material surrounds.

In one embodiment of the invention, the reinforcing member comprises a substantially planar wall with a plurality of the projections extending along an upper edge thereof. Each projection has a base section connected to the upper edge of the wall and an anchoring section extending at an angle from the base section. The planar wall of the reinforcing member is adapted to be fastened to the web of a structural member by appropriate fastening means. The structural member can be a standard C-shaped stud or joist, or it may be any other appropriate structural member designed for connection to a building panel, such as a track, a structural steel I-beam or the like.

In another embodiment of the invention, the reinforced structural member also comprises a two-piece assembly. In this embodiment, the structural member is the same as described above, which may be a standard C-shaped stud or joist, with at least one upper edge flange extending substantially perpendicular to the central web of the stud or joist. However, the upper edge flange is provided with a plurality of longitudinally spaced slots. These slots are designed to receive a plurality of projections which are spaced apart from each other along the upper edge of a reinforcing member which is attached to the central web of the structural member. These projections, when inserted through the slots, extend outwardly from the upper edge flange of the structural member for connection to the building panel.

In one aspect of the invention, the reinforcing member of the second embodiment, described above, has an elongated planar foot section extending substantially perpendicular to a planar wall of the reinforcing member. This foot section and wall section of the reinforcing member are adapted to fit within the C-shaped structural member in an overlapping relationship. If desired, a fastening means, such as a threaded fastener, a spot-welded connection or similar means, may be provided to further secure the reinforcing member to the structural member.

The foregoing structural arrangement of the first and second embodiments of the invention provides several important advantages. Chief among them is the advantage that the reinforcing member can be fastened to a standard C-shaped stud, joist, track, or other conventional structural member. Thus, for example, the studs and joists do not need to be specially modified or specially manufactured, thereby keeping the cost of labor and materials of the finished panel as low as possible. In addition, since a common, off-the-shelf C-shaped stud may be used, modifications and adjustments as between the stud and the reinforcing member can be accommodated in the field in a much more expeditious and economical manner. Moreover, in view of the reinforcement provided by the reinforcing member, a stud constructed from lighter gauge steel, which is less expensive, can be used.

In addition, since the projections which engage with the building panel are not made out of material removed from the edge flange of the stud itself, the stud is not weakened in that area. Furthermore, the projections are not limited in size, shape or number, because they are formed directly on the reinforcing member, thereby providing a more secure connection to the building panel. These projections also can be specially configured to provide an angled hooked shape which will embed in the building panel more securely and provide a stronger bond. These features, combined with the reinforcement of the stud by the reinforcing member, provide the strongest possible building panel.

In another aspect of the invention, bracing of the reinforced structural members is provided by a track that also embeds in and further reinforces the building panel. The track comprises a substantially U-shaped longitudinal member, having a central web and perpendicular edge flanges, for connection to the ends of each reinforced structural member. One of the edge flanges also has an extended portion with a plurality of projections which embed in the concrete material of the building panel. If desired, a plurality of tracks may be used to border all sides of the building panel. This arrangement provides substantial bracing of the structural members and provides further structural reinforcement of the building panel. It also eliminates the need for conventional lateral braces and other devices commonly used to space the studs or joists from each other and to maintain the parallel spacing between them.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The following drawings illustrate the invention. In such drawings:

FIG. 1 is a perspective view of a building panel, partly in cutaway section, showing a reinforced structural member attached to the building panel according to a first embodiment of the present invention;

FIG. 2 is an exploded perspective view of the reinforced structural member according to the first embodiment of the present invention;

DESCRIPTION OF THE PREFERRED EMBODIMENTS

Figure 3:
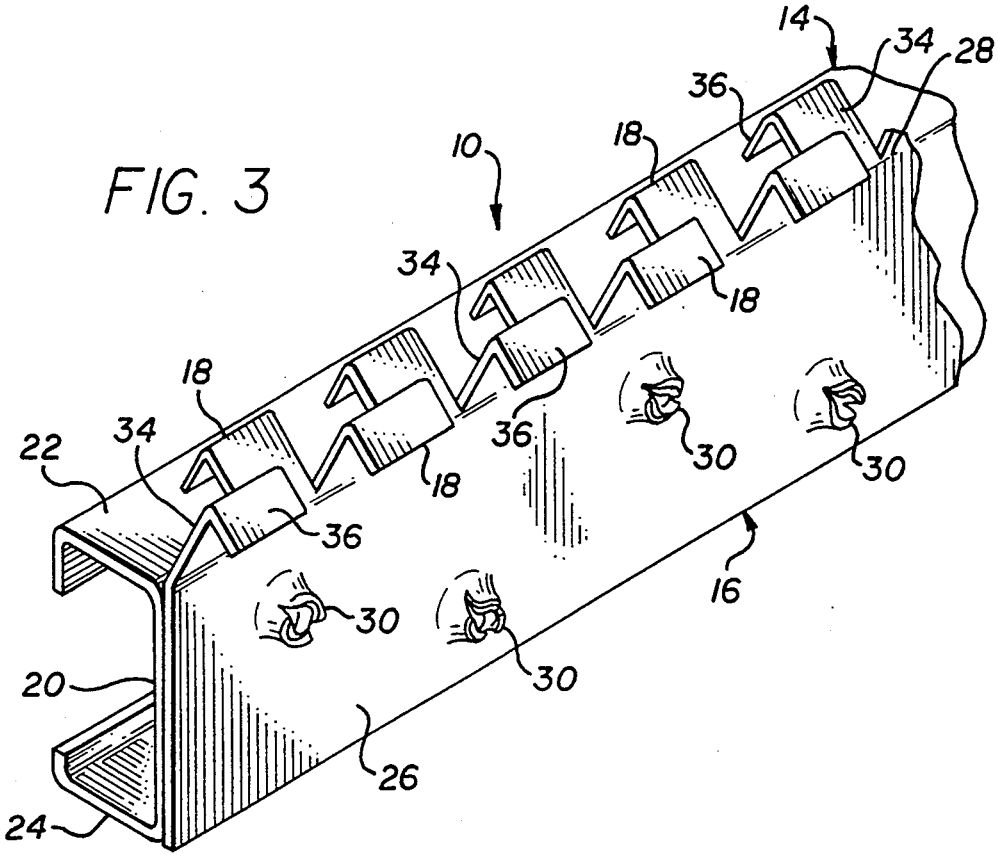
FIG. 3 is an assembled perspective view of the reinforced structural member shown in FIG. 2.

As shown in the exemplary drawings, the present invention is embodied in a reinforced structural member, generally referred to by the reference numeral 10, for connection to a building panel 12 or other appropriate building structure. The reinforced structural member 10 is a two-piece assembly comprising a structural member 14, such as a stud or joist, and a reinforcing member 16. The reinforcing member 16 is fastened to the structural member 14, thereby substantially reinforcing the structural member. In addition, a plurality of projections 18 extending from the reinforcing member 16 are imbedded within the material of the building panel 12. These projections 18 are specially designed to provide an extremely secure connection to the building panel 12, thereby providing a building panel with the highest possible structural integrity.

FIG. 1 is a perspective view, partly in cut-away section, illustrating a plurality of the reinforced structural members 10 arranged in a parallel, spaced relationship. Each of these reinforced structural members 10 has a plurality of the projections 18 embedded within the building panel 12. In this regard, it is noted that the reinforced structural member 10 of the present invention is especially adapted for use with building panels 12 constructed from composite or cementious materials, such as concrete. However, it will be understood that the reinforced structural member 10 is designed for use with any suitable building material capable of hardening from a liquid or semi-liquid state to a solid state. Therefore, the invention is not intended to be limited in any way by the type of material comprising the building panel 12, or other shaped building structure, to which the reinforced structural member 10 is connected. Further details illustrated in FIG. 1 will be described below.

FIG. 2 is an exploded perspective view of a reinforced structural member 10 according to a first embodiment of the invention. The reinforced structural member 10 comprises a two-piece assembly including a structural member 14 and a reinforcing member 16. It is intended that the reinforcing member 16 shall be adapted for connection to any suitable type of structural member 14, such as a standard C-shaped stud or joist. However, the structural member 14 may comprise any other suitable structural member adapted for use in reinforcing, and connection to, a building panel 12. Therefore, by way of example, the structural member 14 shown in FIG. 2 comprises a planar central web 20 having upper and lower edge flanges 22 and 24, respectively, extending in a perpendicular direction with respect to the web. Again, this structural member 14 may be a standard stud or joist constructed, for example, from steel.

According to the first embodiment of the invention, the structural member 14 advantageously retains all of its structural integrity, because the structural member is not altered or modified in any way. Thus, there are no cut-outs or material removed from the structural member 14 that could tend to weaken its structural integrity. Moreover, in view of the reinforcement of this member 14 by the reinforcing member 16, a structural member 14 made from lighter gauge, less expensive steel can be used.

The reinforcing member 16 has a substantially planar wall 26 and a plurality of projections 18 extending from an upper edge 28 of the reinforcing member. The planar wall 26 of the reinforcing member 16 is designed to lie in an overlapping relationship to the central web 20 of the structural member 14. It will be appreciated, however, that the shape of the reinforcing member 16 can be configured as desired to conform to the shape of the structural member 14, which need not be planar.

FIG. 3 shows the reinforcing member 16 fastened to the structural member 14 prior to connection to the building panel 12. Here it can be seen that the upper edge 28 of the reinforcing member 16 is generally aligned with the upper edge flange 22 of the structural member 14, with the planar wall 26 of the reinforcing member 16 in overlapping relationship with the central web 20 of the structural member 14. Suitable fastening means are employed to connect the reinforcing member 16 to the structural member 14. By way of example, as shown in FIG. 3, a punching tool (not shown) may be used to punch a hole through the structural member 14 and the reinforcing member 16. This causes a portion of the material of both of these members to form curved fingers 30 that extend beyond the planar surfaces of these members to fasten them together. This is a common fastening technique used in the construction industry to connect two metal pieces to each other, because it is a relatively quick, reliable and inexpensive fastening means. Alternatively, other fastening means may be used, such as mechanical fastening means in the form of screws, bolts and other mechanical fastening devices. In addition, chemical fastening techniques may be employed as another alternative, using adhesive, welding or other bonding techniques.

Figure 4:
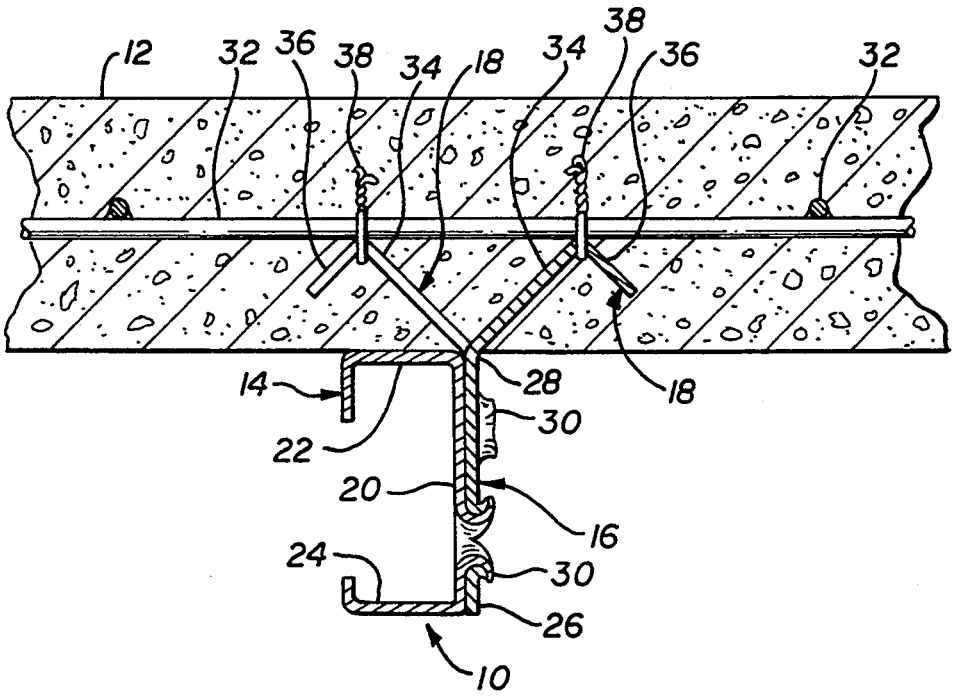
FIG. 4 is a cross-sectional elevational view of a building panel constructed with the reinforced structural member shown in FIG. 3.

FIG. 4 is a cross-sectional, elevational view showing the reinforced structural member 10 connected to the building panel 12. For purposes of illustration, and not by way of limitation, the building panel 12 is shown as being made from concrete or other cementious material. It is noted that each of the projections 18 supports a portion of a reinforcing wire mesh 32 commonly used in building panels poured from concrete.

More particularly, with respect to the projections 18, each projection has a generally planar base section 34 with a lower edge integrally connected to the upper edge 28 of the reinforcing member 16. Each projection 18 also has a generally planar anchoring section 36 extending from the end of the base section 34 opposite the reinforcing member 16. Thus, each projection 18 substantially resembles an inverted "V." Each successive projection 18 faces in an opposite direction from the projection adjacent to it. In this way, the projections 18 alternate facing in opposite directions with respect to each other. This advantageously increases the overall surface area of the reinforcing member 16 that is connected to the building panel 12, thereby increasing the strength of the bond between them.

It also will be noted that each of the projections 18 provides a relatively large surface area for connection to the building panel 12. Since the projections 18 are formed on the reinforcing member 16, the surface area of these projections is not limited by the surface area of the upper edge flange 22 of the structural member 14. In addition, the angled shape of the projections 18 provides a very secure connection to the building panel 12 when the concrete hardens around the projections. Thus, the large surface area and angled shape of the projections 18 results in a superior bond between the overall reinforced structural member 10 and the building panel 12. In addition, the structural member 14 itself is significantly reinforced by the reinforcing member 16 attached to it.

If desired, optional ties 38 may be provided to connect a reinforcing-type mesh 32 to the projections 18. However, in view of the alternating nature of the projections 18, the reinforcing mesh 32 will lie on the top surface of the projections without falling down into contact with the upper edge flange 22 of the structural member 14. This feature advantageously allows placement of the mesh 32 at the appropriate point, such that the mesh will lie at about the midpoint of the thickness of the building panel 12. Of course, other means besides a reinforcing mesh 32 may be used to reinforce the concrete, such as steel or polypropylene-type fibers.

Also, if desired, a decorative design or other configuration may be provided on the outer surface of the completed building panel 12. This can be accomplished by the use of suitable tools or forms (not shown) for pouring the concrete over the projections 18 and reinforcing mesh 32. When the a concrete cures and hardens, the resulting building panel 12 may be lifted up and positioned to form a part of a wall, floor or roof of an overall building structure.

A particular advantage associated with the reinforced structural member 10 is that no laborious bending of projections from the edge flanges 22 or 24 of the structural member 14 is required. Further, the reinforced structural member 10 is particularly advantageous in that the structural member has no cut-outs in its upper edge flange 22 and thus retains all of its original structural integrity. Another advantage is the relatively larger size and greater number of alternating projections 18 on the reinforcing member 16. The size and number of the alternating projections 18 are not limited by the area of the structural member upper edge flange 22 material. When a greater number of large projections 18 are used, the strength of the bond between the reinforced structural member 10 and the building panel 12 is enhanced, resulting in a stronger and more desirable building panel.

In another aspect of the invention, the reinforced structural members 10 are connected to a track 40 to provide the necessary bracing of these members relative to each other and to the building panel 12. As shown in FIG. 1, the track 40 comprises a substantially U-shaped longitudinal member having a central web 42 and perpendicular edge flanges 44. The ends of each reinforced structural member 10 are designed to be received within the U-shaped space provided by the track 40. Appropriate means, such as fasteners, welded connections or the like, may be used to connect the ends of each reinforced structural member 10 to the track 40 at the appropriate lateral spacing. One of the edge flanges 44 of the track 40 also has an extended portion forming a plurality of projections 46 designed to embed within the concrete material of the building panel 12. These projections 46, which may be generally of the same configuration as the projections 18 described above, may be alternating in their orientation with respect to each other, or they may be of any other suitable form.

If desired, a plurality of tracks 40 may be used to border all sides of the building panel 12. In this way, the opposite ends of each reinforced structural member 10 will be connected to a first pair of tracks 40, which will be generally parallel to each other or on opposite sides of the building panel 12. In addition, a second pair of tracks 40, positioned perpendicular to and at the opposite ends of the first pair of tracks 40, may be provided to form a four-sided border or frame surrounding the building panel 12. This arrangement provides substantial bracing of the reinforced structural members 10 and provides further structural reinforcement of the building panel 12 in which the tracks 40 are embedded. The tracks 40 also eliminate the need for conventional lateral braces or other devices commonly used to space studs or joists from each other and to maintain the parallel spacing between them.

In use, after a plurality of reinforced structural members 10 are assembled, they are placed in a parallel spaced relationship and braced by four tracks 40. The reinforcing mesh 32 may then be mechanically connected to the projections 18, such as by the wire ties 38, as shown in FIG. 4, or by any other suitable method. The entire assemblage of parallel reinforced structural members 10 and tracks 40, along with the attached mesh 32, is then placed in a position, in combination with appropriate forms (not shown), so that concrete or the like can be poured over the projections 18 and 46. When the concrete cures, the projections 18 and 46 will securely attach the reinforced structural members 10 and tracks 40 to the building panel 12. Thereafter, the entire panel 12 may be lifted up and positioned as part of a wall, floor or roof of a building structure.

Figure 5:
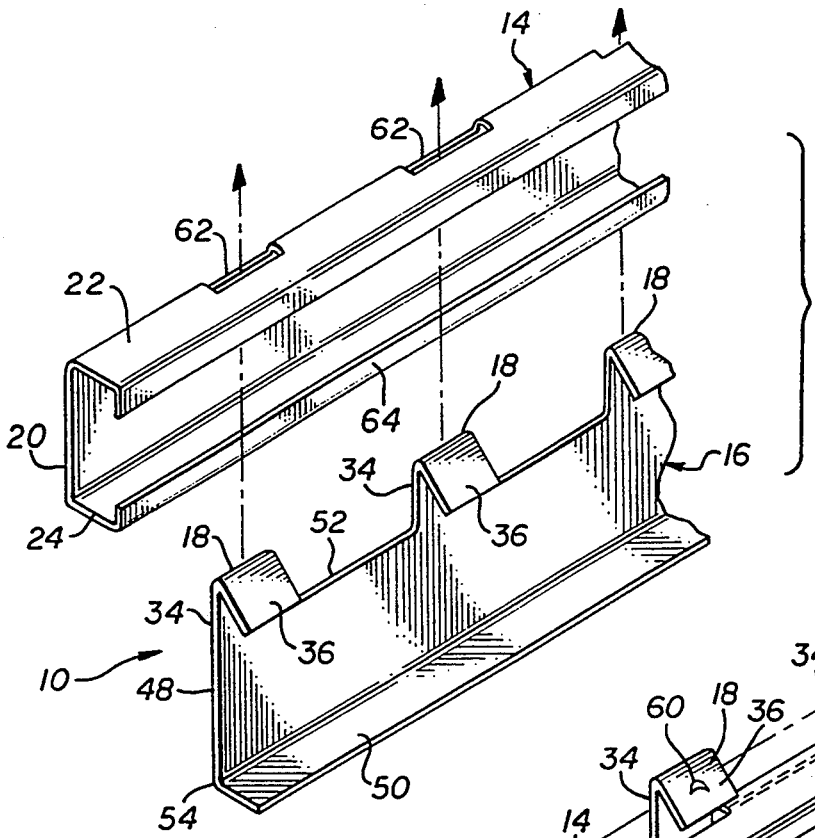
FIG. 5 is an exploded perspective view of a reinforced structural member according to a second embodiment of the present invention.
Figure 6:
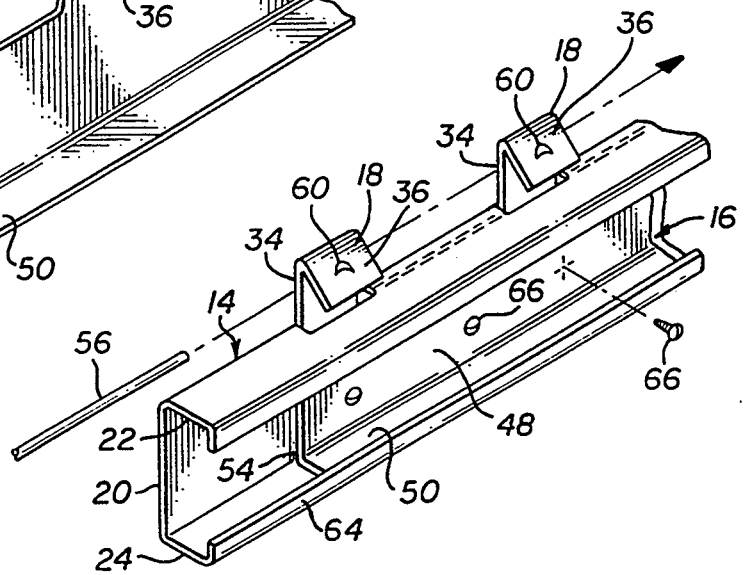
FIG. 6 is an assembled perspective view of the reinforced structural member shown in FIG. 5.
Figure 7:
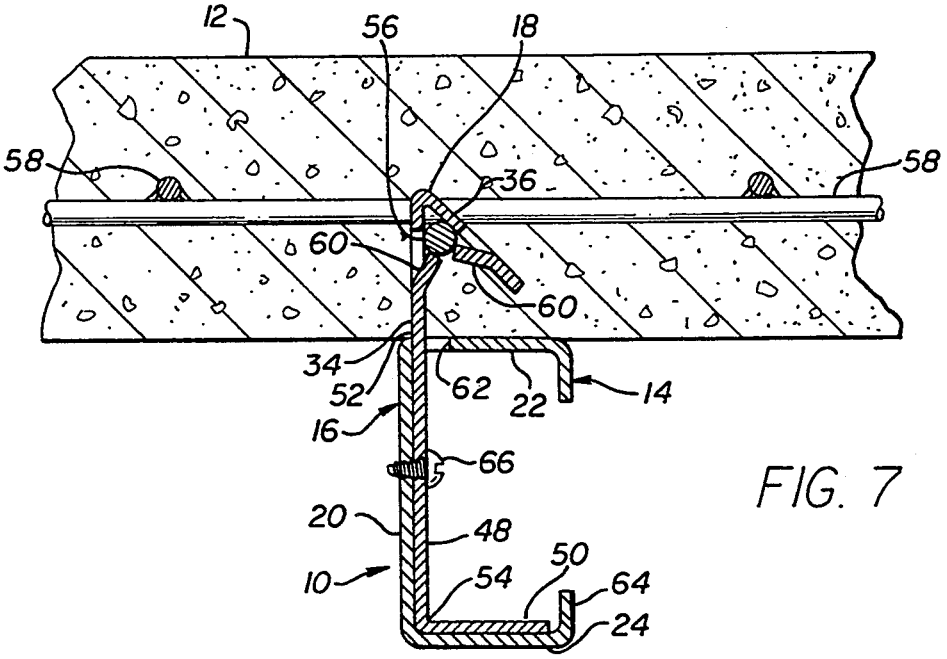
FIG. 7 is a cross-sectional elevational view of a building panel constructed with the reinforced structural member shown in FIG. 6.

FIGS. 5–7 show a second embodiment of the invention. In this embodiment, the reinforcing member 16 has a plurality of longitudinally spaced projections 18 extending from a planar wall 48 which, in turn, has a lower planar foot 50. The projections 18 extend along an upper edge 52 of the wall 48, with the lower foot 50 joined in a perpendicular manner to a lower edge 54 of the wall. Like the first embodiment described above, each projection 18 has a generally planar base section 34 and a generally planar anchoring section 36 connected at an angle to the base section. The base section 34 preferably is joined to the upper edge 52 of the reinforcing member 16 such that it is integral with and lies in substantially the same plane. The anchoring section 36 preferably extends from the base section 34 at an acute angle.

In the second embodiment of the invention, each projection 18 is designed to receive a tubular rod 56 for supporting a reinforcing wire mesh 58. As shown in FIG. 7, the rod 56 is retained in a position spaced from the upper edge flange 22 of the structural member 14 by a pair of inwardly projecting tabs 60. These tabs 60 are formed from the material comprising the base section 34 and the anchoring section 36 and may be formed by appropriate punching or stamping techniques. The tabs 60 allow the rod 56 to be pressed upwardly between the tabs and retained in the position shown in FIG. 7.

The structural member 14 of the second embodiment also can be a standard C-shaped stud or joist. However, the upper edge flange 22 of the structural member 14 has a plurality of elongated, spaced slots 62. These slots 62 are designed to receive the projections 18 of the reinforcing member 16, such that the projections 18 pass through the slots 62 and extend outwardly beyond the upper edge flange 22. In one form of the invention, the slots 62 can be sized so that the projections 18 of the reinforcing member 16 can be passed through the slots by rotational motion which essentially "threads" the projections through the slots. Alternatively, the material of the reinforcing member 16, at least in the area comprising the projections 18, can be configured such that the projections will elastically deform as they pass through the slots 62 and then return substantially to their original shape thereafter. Suitable materials having elastic characteristics can be used to construct the reinforcing member 16 to achieve this result.

The foot 50 of the reinforcing member 16 is designed to be received within the space defined by the web 20 and lower edge flange 24 of the structural member 14. To this end, the structural member 14 may have an up-turned portion 64 at the free-end of the lower edge flange 24 to help retain the foot 50 in position, such that the reinforcing member 16 will snap into and assume an overlapping relationship with the structural member 14. If desired, fastening means may be provided to further secure the reinforcing member 16 to the structural member 14. This fastening means may comprise a mechanical fastener, such as a bolt or screw 66, or it may comprise a chemical fastener, such as an adhesive or welded connection.

More particularly, to assemble the components of the reinforced structural member 10, the reinforcing member 16 is placed so that the projections 18 are directly under the slots 62 in the upper edge flange 22, and the planar wall 48 of the reinforcing member 16 is near the central web 20 of the structural member 14. The reinforcing member 16 is then forced upwards so that the projections 18 deform elastically and squeeze through the slots 62. The projections 18 then retake their original shape after passing through the slots 62 so that the reinforcing member 16 and the structural member 14 are locked together. After the projections 18 pass through the slots 62, the wall 48 of the reinforcing member 16 will come into planar contact with the inner surface of the structural member central web 20. In addition, the reinforcing member foot 50 comes into planar contact with the inner surface of the structural member lower edge flange 24.

Alternatively, the slots 62 may be sized so that the projections 18 can pass through by a rotational movement. To achieve such rotation of the projections 18 through the slots 62, the wall 48 of the reinforcing member 16 is placed perpendicular to the central web 20 of the structural member 14, with the free ends of the projections near the slots. The free ends of the projections 18 are then moved through the slots 62, and the wall 48 of the reinforcing member 16 is rotated into full contact with the central web 20 of the structural member 14, so that the projections 18 extend through the slots 62.

When the reinforcing member 16 and the structural member 14 overlap each other, the projections 18 extend above the structural member upper edge flange 22 and can be securely embedded in the concrete panel 12. Because the projections 18 are either threaded or deformed through the slots 62, the reinforcing member 16 and the structural member 14 cannot be separated. In addition to the projections 18, the foot 50 holds the reinforcing member 16 and the structural member 14 together by a tight snap-like fit on the inside surface of the structural member lower edge flange 24. However, to assure a more secure connection, the fasteners 66 can be used to fasten the wall 48 of the reinforcing member 16 to the central web 20 of the structural member 14.

To finish the assembly of the reinforced structural member 10 of the second embodiment, the rod 56 is positioned under the projections 18 and moved upward past the tabs 60, which prohibit the movement of the rod 56 in the opposite, downward direction. An advantage associated with the tabs 60 is that they allow the rod 56 to be quickly and securely installed, resulting in a savings of labor and time. The rod 56 runs the through the projections 18 along the entire length of the reinforcing member 16 and can be attached to the reinforcing mesh 58 by wire tying or any other suitable process. The reinforcing rod 56 advantageously provides continuous attachment points for the reinforcing mesh 58. After the reinforced structural members 10 are braced by the tracks 40, the building panel 12 may be poured in the same manner described above in connection with the first embodiment of the invention.

Many advantages are associated with the second embodiment of the invention. First, because the size of the upper edge flange slots 62 does not have to equal the surface area of the projection 18, the slot size can be relatively small. Accordingly, the structural member 14 retains substantially all of its structural rigidity and strength as compared to a common metal stud with projections formed from flange hole cut-outs. Second, because the size and shape of the projections 18 are not limited by the size of the upper edge flange 22, a greater number of large projections 18 can be utilized to anchor the overall structural member 10 to the concrete panel 12.

From the foregoing, it will be appreciated that the present invention provides a reinforced structural member 10 that can be inexpensively manufactured and quickly assembled in the field for connection to a building panel 12 or the like. The reinforcing member 16 advantageously reinforces the structural member 14, while the projections 18 on the reinforcing member 16 securely fasten the assembled member 10 to the building panel 12. The tracks 40 provide the necessary bracing for the members 12, while the track projections 46 also provide a further connection to the building panel 12. This overall combination yields a building panel 12 with increased structural integrity.

While a particular form of the invention has been illustrated and described, it will be apparent that various modifications can be made without departing from the spirit and scope of the invention. Accordingly, it is not intended that the invention be limited, except as by the appended claims.

We claim:

1. A reinforced structural member for connection to a building panel, comprising:

(a) a structural member having an elongated web;

(b) a reinforcing member for attachment to the structural member, wherein the reinforcing member has an elongated wall and a plurality of projections for connection to the building panel; and (c) a fastener that connects the wall of the reinforcing member to the web of the structural member, such that the projections extend outwardly from the structural member for connection to the building panel, and such that the wall of the reinforcing member substantially reinforces the structural member.

2. The reinforced structural member of claim 2, wherein each of the projections has a base section with one end connected to the reinforcing member and another end connected to an anchoring section.

3. The reinforced structural member of claim 2, wherein the base section of each projection is substantially planar, and wherein the anchoring section of each projection is substantially planar and extends from the base section such that an acute angle is formed between the base section and the anchoring section.

4. The reinforced structural member of claim 2, wherein the building panel is constructed from a material capable of hardening over a period of time from a liquid or semi-liquid state to a solid state which adheres to the projection and thereby connects the building panel to the reinforced structural member.

5. The reinforced structural member of claim 4, wherein the material comprises a cementious material.

6. The reinforced structural member of claim 4, further comprising a reinforcing material supported by and connected to the projections for reinforcing the material after it has hardened into a solid state.

7. The reinforced structural member of claim 2, wherein the fastening means comprises a mechanical fastening means.

8. The reinforced structural member of claim 2, wherein the fastening means comprises a chemical fastening means.

9. The reinforced structural member of claim 2, wherein the web of the structural member is substantially planar.

10. The reinforced structural member of claim 2, wherein the structural member also has at least one edge flange extending substantially perpendicularly with respect to the web.

11. The reinforced structural member of claim 2, wherein the elongated wall of the reinforcing member is substantially planar.

12. A reinforced structural member for connection to a building panel, comprising:

(a) a structural member having an elongated web, wherein the web has one edge adapted to be positioned adjacent to a building panel;

(b) a reinforcing member for attachment to the structural member, wherein the reinforcing member has an elongated wall for connection to and reinforcement of the web of the structural member, and wherein the reinforcing member has a plurality of projections extending from one edge of the wall; and (c) fastening means for fastening the wall of the reinforcing member to the web of the structural member, such that the edges of each of the structural member and the reinforcing member are substantially aligned with each other, with the projections extending beyond the one edge of the structural member for connection to the building panel.

13. The reinforced structural member of claim 12, wherein the web of the structural member and the wall of the reinforcing member are substantially planar.

14. The reinforced structural member of claim 13, wherein the building panel is constructed from a material capable of hardening over a period of time from a liquid or semi-liquid state to a solid state which adheres to the projection and thereby connects the building panel to the reinforced structural member.

15. The reinforced structural member of claim 14, further comprising a track for bracing and maintaining a lateral spacing between a plurality of reinforced structural members, wherein the track includes a plurality of projections for attachment to the building panel.

16. The reinforced structural member of claim 15, wherein the track comprises an elongated planar web with at least one edge flange extending perpendicularly with respect to the web, and wherein the ends of each reinforced structural member are connected to the track, with the projections on said end flange being adapted to embed within and thereby connect the track to the building panel.

17. A reinforced structural member for connection to a material capable of hardening from a liquid or semi-liquid state into a solid state, comprising:

(a) a structural member having an elongated planar web and an elongated planar flange extending substantially perpendicular thereto, the planar flange defining a plurality of longitudinally spaced slots; and (b) a reinforcing member for attachment to the structural member comprising;

a planar wall shaped to conform to the planar web of the structural member; and a plurality of longitudinally spaced projections extending from one edge of the planar wall for insertion through said slots, each projection having a base section connected to the planar wall and an anchoring section connected to the base section, the anchoring section being adapted for insertion into said material; and (c) fastening means for attaching the reinforcing member to the structural member such that the anchoring section of each projection extends beyond the flange of the structural member for connection to said material.

18. The reinforced structural member of claim 17, wherein the structural member further includes a second flange extending substantially perpendicular to the planar web, and the reinforcing member has an additional elongated planar foot section extending in a substantially perpendicular direction with respect to the bottom of the planar wall.

19. The reinforced structural member of claim 18, wherein the base section of each projection is substantially planar, and the anchoring section of each projection is substantially planar and extends from the base section such that an acute angle is formed between the base section and the anchoring section.

20. A reinforced building structure, comprising:

(a) a building panel constructed from a material capable of hardening over a period of time from a liquid or semi-liquid state to a solid state;

(b) a reinforced member, comprising a structural member and a reinforcing member for attachment to the structural member, wherein the reinforcing member has a plurality of projections which extend from one edge thereof;

(c) fastening means for fastening the reinforcing member to the structural member, such that the projections extend outwardly from the structural member for embedment within the material of the building panel; and (d) a track for bracing and maintaining a lateral spacing between a plurality of said structural members, wherein the track also includes a plurality of projections for embedment within and adherence to the material of the building panel.

21. A reinforced building structure for connection to a building panel, comprising:

a reinforced structural member having (a) a structural member, (b) a reinforcing member for attachment to the structural member, wherein the reinforcing member has a plurality of projections for connection to the building panel, and (c) a fastener that connects the reinforcing member to the structural member, such that the projections extend outwardly from the structural member for connection to the building panel; and a track for bracing and maintaining a lateral spacing between the reinforced structural member and another structural member, wherein the track includes a plurality of projections for attachment to the building panel.

* * * * *